US005927510A

United States Patent [19]

Leute et al.

[11] Patent Number: 5,927,510

[45] Date of Patent: Jul. 27, 1999

[54] PARTICLE CLASSIFICATION APPARATUS AND PROCESSES THEREOF

[75] Inventors: Gerardo Leute, Penfield; Lewis S. Smith, Fairport, both of N.Y.

[73] Assignee: Xerox Corporation, Stamford, Conn.

[21] Appl. No.: 08/801,225

[22] Filed: Feb. 19, 1997

[51] Int. Cl.[6] ..... B07B 4/00

[52] U.S. Cl. ..... 209/142; 209/139.2; 55/345; 55/347

[58] Field of Search ..... 209/139.2, 142, 209/713, 714; 55/345, 347

[56] References Cited

U.S. PATENT DOCUMENTS

| | | | |
|---|---|---|---|
| 2,270,143 | 1/1942 | Schaich | 209/139.2 X |
| 3,089,595 | 5/1963 | Kaiser | 209/714 X |
| 3,498,453 | 3/1970 | Kaiser et al. | 209/714 X |
| 4,689,140 | 8/1987 | Folsberg | 209/139.2 |
| 4,693,811 | 9/1987 | Lohnherr | 209/139.2 |
| 4,935,123 | 6/1990 | Csillag et al. | 209/144 |
| 5,244,481 | 9/1993 | Nied | 55/406 |
| 5,263,655 | 11/1993 | Giammaruti et al. | 241/119 |
| 5,263,855 | 11/1993 | Watson et al. | 241/119 |
| 5,366,095 | 11/1994 | Martin | 209/139.2 |
| 5,377,843 | 1/1995 | Schumacher | 209/139.2 |
| 5,624,039 | 4/1997 | Folsberg | 209/714 |

FOREIGN PATENT DOCUMENTS

| | | | |
|---|---|---|---|
| 0680572 | 8/1939 | Germany | 209/139.2 |

*Primary Examiner*—Johnny D. Cherry
*Assistant Examiner*—Steven B. McAllister
*Attorney, Agent, or Firm*—John L. Haack

[57] ABSTRACT

An apparatus for the classification of solid particulates entrained in a fluid, comprising: a housing provided with a feed inlet, a fine fraction outlet, and a coarse fraction outlet; and a classifier wheel having an upper and lower surface, and a plurality of blade vanes connecting the upper surface to the lower surface at the peripheral edges of the upper and lower surfaces, and wherein the wheel has a constant cut point geometry.

20 Claims, 6 Drawing Sheets

PARTICLE CLASSIFICATION APPARATUS AND PROCESSES THEREOF

REFERENCE TO COPENDING AND ISSUED PATENTS

Attention is directed to commonly owned and assigned U.S. Pat. No. 5,133,504, issued Jul. 28, 1992, entitled "THROUGHPUT EFFICIENCY ENHANCEMENT OF FLUIDIZED BED JET MILL," and U.S. Pat. No. 5,562,253, issued Oct. 8, 1996, entitled "THROUGHPUT EFFICIENCY ENHANCEMENT OF FLUIDIZED BED JET MILL".

Attention is directed to commonly owned and assigned, application U.S. Ser. No. 08/571,664 filed Dec. 13, 1995, now U.S. Pat. No. 5,628,464, entitled "FLUIDIZED BED JET MILL NOZZLE AND PROCESSES THEREWITH," wherein there is disclosed a fluidized bed jet mill for grinding particulate material including a jetting nozzle comprising: a hollow cylindrical body; an integral face plate member attached to the end of the cylindrical body directed towards the center of the jet mill; and an articulated annular slotted aperture in the face plate for communicating a gas stream from the nozzle to the grinding chamber to form a particulate gas stream in the jet mill.

The disclosures of each the above mentioned patents and copending applications are incorporated herein by reference in their entirety.

BACKGROUND OF THE INVENTION

The present invention is generally directed to an apparatus and processes thereof for the preparation of particulate materials with narrow particle size distribution properties. More specifically, the present invention relates to improved classifier chamber geometries, such as a height level profile, and which profiles enable a high level of control over the physics of the separation process in the classifier and thereby provide a constant cut point in the free vortex region of the classifier.

In particle processing arts, for example, for the preparation of fine and uniformly disperse particulate materials, there exists various equipment and mechanical processes for achieving selective separation of particulate powders into eligible and non-eligible particle size fractions or ranges, and are collectively referred to as classifiers and classification.

In the manufacture of particulate powders, such as electrostatographic toner compositions, a classifier apparatus employing a rotating wheel is commonly used to accomplish classification. In general, the rapidly rotating classifier wheel creates a dynamical fluid vortex which provides the necessary forces to achieve separation of particles greater than a certain size from particles less than a certain size.

The extent or sharpness of the separation of particles of different sizes achieved by the classifier is an important measure of the quality of the separation equipment and process, and is generally reflected in the quality of the resultant particles, for example, the physical performance characteristics and properties of the particles. The sharpness of the separation is also a measure of how well the classifier can discriminate among similarly sized particles. Ideally, a classifier will separate a feed particle stream containing a mixture of fine and coarse particles sizes into two distinct streams: a coarse stream and a fines stream with little or no overlap in size distribution.

The degree of sharpness of the separation is measured using a coarse grade efficiency calculation. The calculation indicates what fraction of particles with a certain size will travel to the coarse stream, and what fraction will travel to the fines stream. A ratio of the size at which 25 percent of the particles travel to the coarse stream ($D_{25}$) and the size at which 75 percent of the particles travel to the coarse stream ($D_{75}$) is used as a nominal measure of sharpness($D_{25}/D_{75}$). An ideal separation provides a sharpness ($D_{25}/D_{75}$) equal to 1. In currently available commercial classification equipment, a sharpness index exceeding a value of 0.7, for example, from about 0.7 to about 1.0, is considered to be excellent and considered difficult to attain without exceptional effort and operating conditions.

Commercially available classifier wheels generally provide little or no profiling, or only provide a profile which maintains a constant wheel height or constant air flow radial velocity. These conditions typically result in a particle cut point situation which diminishes towards the particle outlet, and is believed to lead to an undesirable buildup of solids concentration in the free vortex region.

PRIOR ART

U.S. Pat. No. 5,244,481, issued Sep. 14, 1993, to Nied, discloses a vertical air separator with a rotating separator wheel upon which separating air loaded with fine goods flowing from outside towards the inside impinges, from which said separating air axially flows off through an outlet connection pipe in order to be guided to its further use, e.g. in a filter or the like, said separating wheel being provided with a down stream cover plate and a second cover plate being axially distance therefrom, and blades being disposed between the two cover plates at their periphery, and the outlet connection delivery end averted from the separating wheel emptying into an outlet chamber the cross section of which is distinctly larger than the cross section of the said outlet connection pipe so that there occurs an abrupt change of the cross section between the outlet connection pipe and the said outlet chamber. A constant radial velocity wheel is described, wherein the airflow velocity is constant regardless of the radial position in the wheel, reference col. 7, lines 21–32.

U.S. Pat. No. 5,377,843, to Schumacher, issued Jan. 3, 1995, discloses a classifying wheel for a centrifugal-wheel air classifier, through which the classifying air flows from outside to the inside against its centrifugal action. The wheel has blades arranged in a ring extending parallel to the axis of rotation of the wheel. The blades are positioned between a circular disc carrying the classifying wheel hub and an annular cover disc. The classifying wheel is entirely made in one piece and of a wear-resistant sintered material. The flow channels of the classifying wheel are formed by the surfaces of the classifying wheel blades extending parallel to each other and in direction of the axis of rotation of the wheel. The cut point of the fine product can be precisely controlled by varying the rotational speed of the turbine. This maintenance free design produces unmatched sharpness in cut size. The lack of internal seals makes oversize "leakage" impossible and allows air flows to be maximized resulting in extremely high product yields.

U.S. Pat. No. 5,366,095, to Martin, issued Nov. 22, 1994, discloses an air classification system comprised of dual cylindrical chambers mechanically separated, to allow a zone of atmospheric air in between. A primary classification chamber situated vertically below a concentric secondary classification chamber. A rotating parallel blade turbine is situated within the lower primary chamber in order to effect centrifugal particle classification upon a feed material intimately mixed in an air stream. A tubular rotary discharge connected to the turbine which passes through the zone of atmospheric air separating the dual chambers, and extends into the upper secondary chamber which exits to collect and discharge the classified product from the system. A classifier of this design is capable of separating ultra fine particles without stray amounts of oversize with extremely high fine product yields.

The aforementioned references are incorporated in their entirety by reference herein.

In the particle separation and classification processes of the prior art, various significant problems exist, for example, difficulties in predicting or controlling both the particle size and particle size distribution of the particulate products produced.

Other disadvantages associated with the prior art methods for separating particulate materials are that they typically provide products with highly variable particle size and or particle size distribution properties.

These and other disadvantages are avoided, or minimized with the apparatus and processes of the present invention.

Thus, there remains a need for particle separation apparatus and processes, which provide for the preparation, separation and classification of the particular material, for example, pigmented resin particles used in dry toner and liquid ink applications.

Practitioners in the art have long sought an inexpensive, efficient and environmentally efficacious means for producing narrow particle size distributions using conventional classification and separation equipment, having operator controllable or selectable particle size and particle size distribution properties.

SUMMARY OF THE INVENTION

Embodiments of the present invention, include:

overcoming, or minimizing deficiencies of prior art apparatus and particulate separation processes, by providing classification processes with improved efficiency, improved flexibility, and improved operational economies;

providing an apparatus for the radial flow classification of solid particulate materials entrained in a fluid, comprising: a housing provided with a feed inlet, a fine fraction outlet, and a coarse fraction outlet; and a classifier wheel having an upper and lower surface, and a plurality of blade vanes connecting the upper surface to the lower surface at the peripheral edges of the upper and lower surfaces, and wherein the wheel has a constant cut point geometry;

providing an apparatus with a constant cut point geometry which satisfies the relation $$d_T = \sqrt{\frac{18\eta Q R^2}{8\rho\pi^3 R_i^4 n^2 H}}$$

wherein $d_T$ is the cut point, η is the dynamic viscosity, Q is the volumetric air flow rate, ρ is the density of particle material, n is the wheel speed in revolutions per unit time, H is the wheel height at a radial distance R, and the index i denotes the inner edge of the wheel vane; and providing an apparatus wherein the constant cut point geometry satisfies the relation, $H=\text{constant}\times R^2$, where H is the wheel height at a radial distance R. The wheel height H, is the distance between the two inner surfaces of the upper and lower wheel surfaces at a given radius.

Still other embodiments of the present invention include processes for separating and classifying particulate materials comprising:

providing an apparatus for the radial flow classification of solid particulate materials entrained in a fluid, comprising a housing provided with a feed inlet, a fine fraction outlet, and a coarse fraction outlet; and a classifier wheel having an upper surface, a lower surface, and a plurality of blade vanes connecting the upper surface to the lower surface at the peripheral edges of the surfaces, and wherein the wheel has a constant cut point geometry;

rotating the wheel at high speed; and providing a particle feed comprising a fluid stream containing particulates of various sizes to the apparatus, wherein the particulates in the fluid stream are classified according to a constant cut point within the apparatus such that fine particles move to the center of the wheel and thereafter exit the housing via the fine fraction outlet, and the coarse particles move to the periphery of the wheel and exit the wheel via the coarse fraction outlet.

DETAILED DESCRIPTION OF THE INVENTION

The particulate classification and separation apparatus and processes thereof of the present invention may be used to process and prepare a variety of particulate materials, including toner particles for used in liquid and dry developer marking applications in a cost efficient manner. An advantage of the present invention is that the apparatus and processes thereof afford precise control over the particle size and particle size distribution properties of the resulting separated fine particulate products.

Figure 4A:
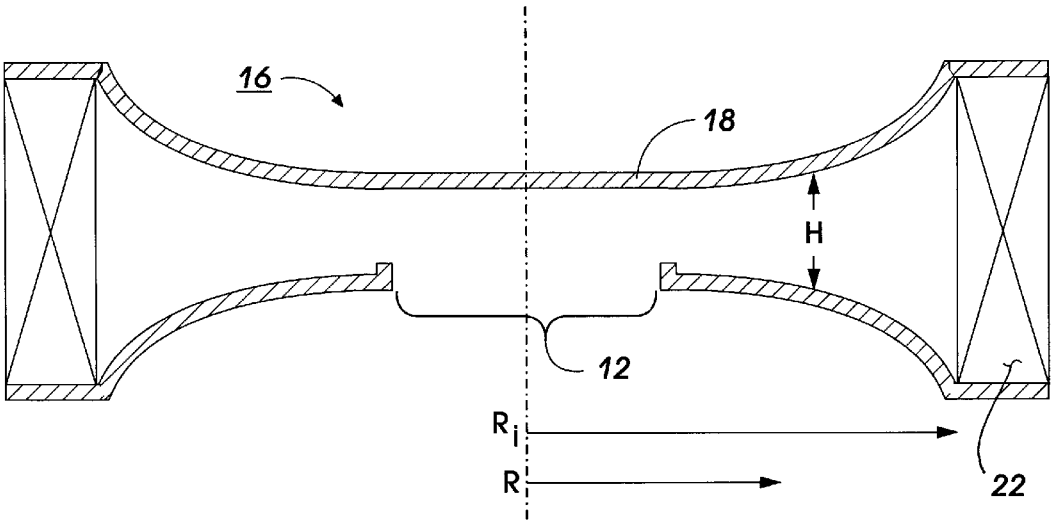
FIG. 4*a* and 4*b*, in embodiments of the present invention, respectively illustrate, a cross sectional profile of a classifier wheel, and a graphical representation of the corresponding cut point profile of the classifier wheel.
Figure 4B:
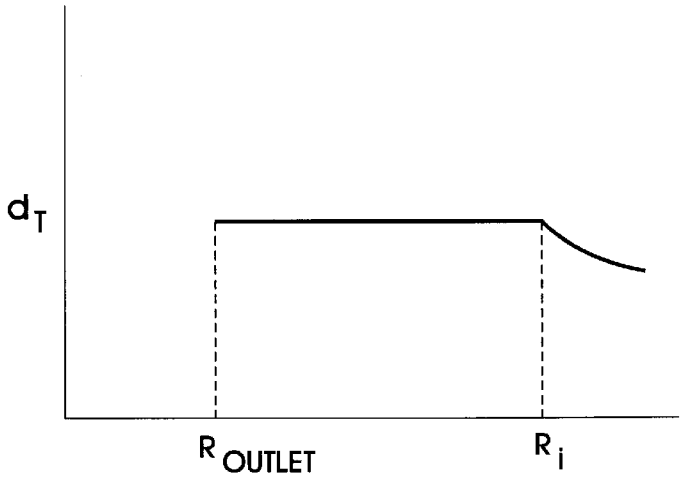
Figure 5:
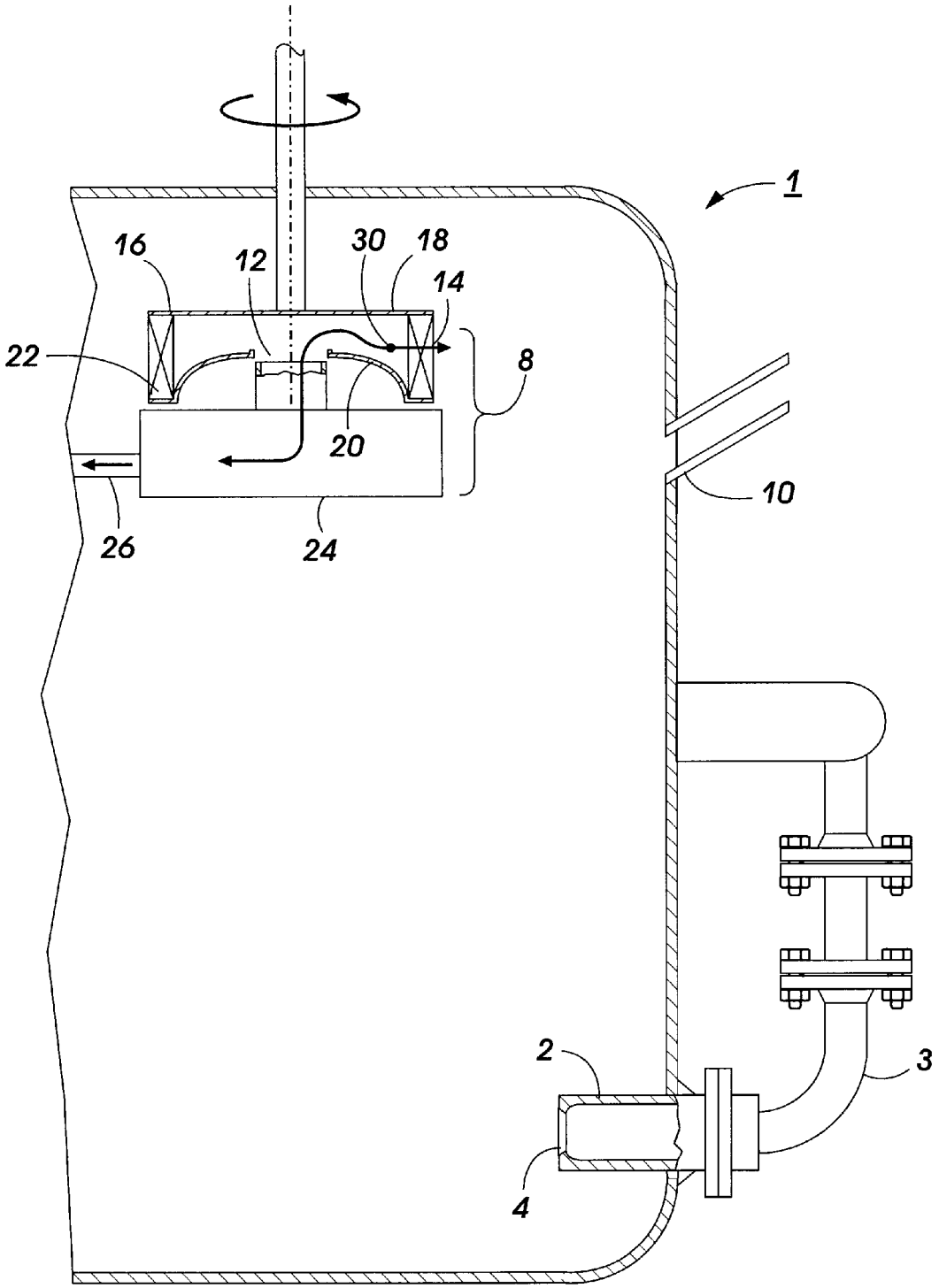
FIG. 5, in embodiments of the present invention, illustrates the constant point cut classifier wheel of FIG. 3*a* incorporated within a fluidized bed grinder-classifier apparatus.
Figure 6:
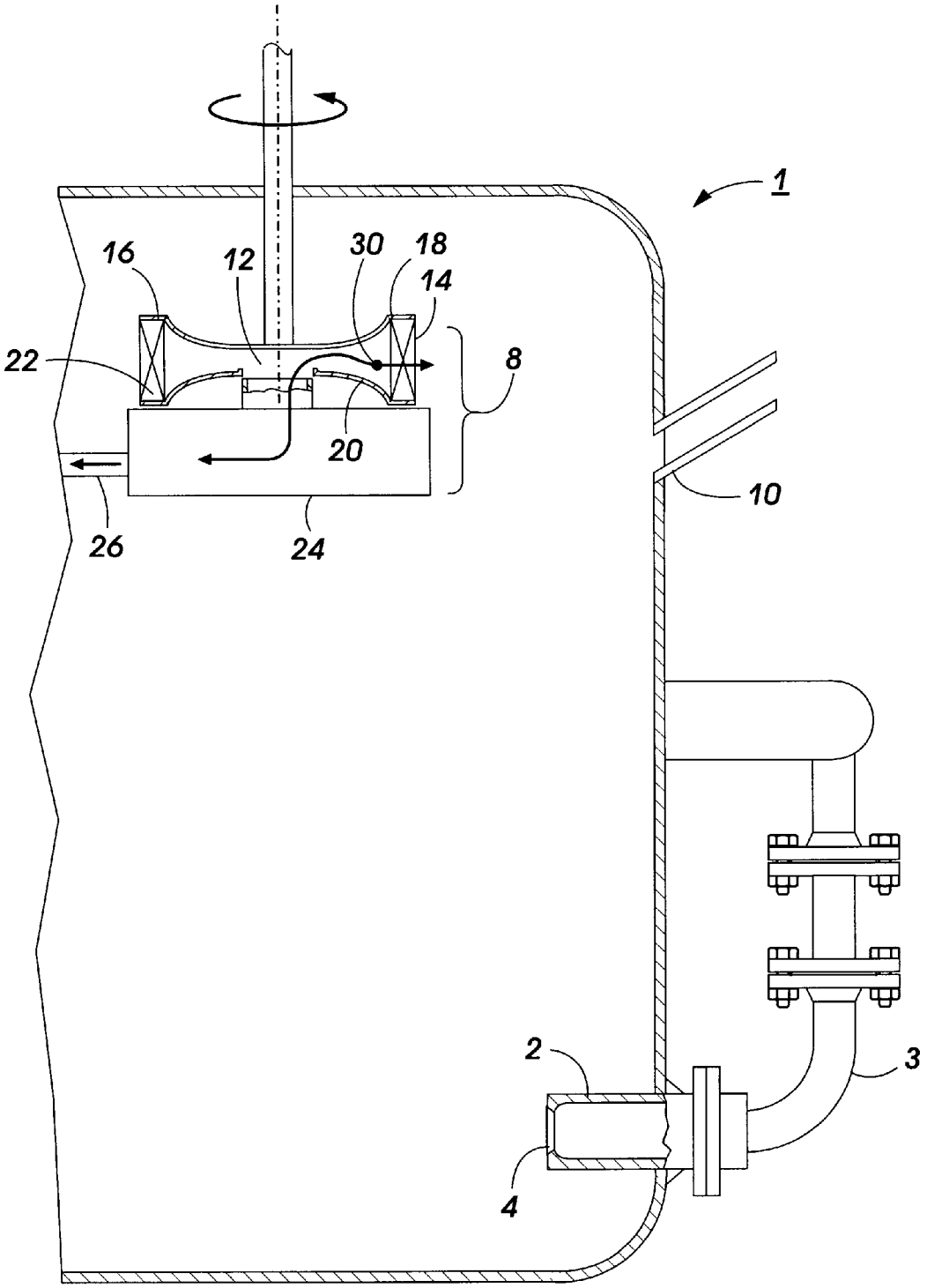
FIG. 6, in embodiments of the present invention, illustrates the constant point cut classifier wheel of FIG. 4*a* incorporated within a fluidized bed grinder-classifier apparatus.

In embodiments, and referring the FIGS. 3–6, the present invention provides an apparatus for the radial flow classification of solid particulate materials entrained in a fluid, for example, as shown in FIGS. 5 and 6, comprising: a housing (1) provided with a feed inlet chute(10), a fine fraction outlet(12), and a coarse fraction outlet(14); and a classifier wheel(16) having an upper(18) and a lower(20) surface, and a plurality of blade vanes(22) connecting the upper surface to the lower surface at the peripheral edges of the upper and lower surfaces, and wherein the wheel(16) has a constant cut point geometry. Thus, a particle (30) initially entrained in the classifier wheel (16) will exit the wheel(16) either through the coarse fraction outlet (14) if above a critical or cut point particle size diameter or through the fine fraction outlet (12) if below a critical or cut point particle size diameter. Components including nozzle(2), air line(3), nozzle opening (4), and classifier assembly(8) are known in the art, reference the aforementioned U.S. Pat. No. 5,628,464.

In embodiments the apparatus of the present invention provides a constant cut point geometry which satisfies the relation $$d_T = \sqrt{\frac{18\eta Q R^2}{8\rho\pi^3 R_i^4 n^2 H}}$$

wherein $d_T$ is the cut point, η is the dynamic viscosity, Q is the volumetric air flow rate, ρ is the density of particle material, n is the wheel speed in revolutions per unit time, H is the wheel height at a radial distance R, and the index i denotes the inner edge of the wheel vane.

In other embodiments, the constant cut point geometry satisfies the relation, $H=\text{constant}\times R^2$, where H is the wheel height at a radial distance R.

The classifier wheel of the present invention has an upper surface and a lower surface. In embodiments, these surfaces can be, for example, an upper surface which resides in a plane, and a lower surface which is inwardly curvilinear, or concaved, in the direction of the plane from about the peripheral lower surface edge of the wheel to about the center lower surface edge of the wheel. In embodiments, the lower surface resides in a plane, and the upper surface is inwardly curvilinear, or concaved, in the direction of the plane from about the peripheral upper edge of the wheel to about the center upper edge of the wheel.

In embodiments, both the upper surface and the lower surfaces of the wheel can be inwardly curvilinear, or concaved, from about the peripheral edges of the wheel to about the center edges of the wheel. The spatial relationship, or profile, of the upper surface with respect to the lower surface, whether curved or straight, can be modified in to optimize the degree of separation so long as the relationship above for the cut point $d_T$ is substantially satisfied. Although not wanting to be limited by theory, it is believed that a symmetric profile of upper and lower surfaces is, in embodiments, a preferred profile for achieving the desired wheel height progression from the blade periphery to the center outlet. It will be readily evident to one of ordinary skill in the art that the relative orientation in space of the upper and lower surfaces of the assembled classifier wheel is not critical and can function satisfactorily when oriented in any direction.

In operation the particle feed can be provided to the apparatus in various known ways, for example, as a fluid containing suspended particles, or a fluidized particle stream. A preferred fluid is a gas, for example, dry air at or near atmospheric temperature and pressure.

The solid particulate can be any material which is readily separable by the classifier wheel and is preferably friable, a non- or only weakly agglomerating, for example, a toner formulation comprising particles of a mixture of a pigment and a resin.

In embodiments, the present invention provides processes for separating and classifying particulate materials comprising:

providing an apparatus for the radial flow classification of solid particulate materials entrained in a fluid, comprising a housing provided with a feed inlet, a fine fraction outlet, and a coarse fraction outlet; and a classifier wheel having an upper surface, a lower surface, and a plurality of blade vanes connecting the upper surface to the lower surface at the peripheral edges of the surfaces, and wherein the wheel has a constant cut point geometry;

rotating the wheel at high speed; and providing a particle feed comprising a fluid stream containing particulates of various sizes, for example, less than about 10,000 microns, and preferably less than about 1,000 microns, to the apparatus, wherein the particulates in the fluid stream are classified according to a constant cut point within the apparatus such that fine particles move to the center of the wheel and exit the housing via the fine fraction outlet and the coarse particles move to the periphery of the wheel and exit the wheel via the coarse fraction outlet.

The classifier wheel, in embodiments, has a constant cut point geometry which satisfies the relation $$d_T = \sqrt{\frac{18\eta Q R^2}{8\rho\pi^3 R_i^4 n^2 H}}$$

wherein $d_T$ is the cut point, η is the dynamic viscosity, Q is the volumetric air flow rate, ρ is the density of particle material, n is the wheel speed in revolutions per unit time, H is the wheel height at a radial distance R, and the index i denotes the inner edge of the wheel vane.

The classifier wheel of the present invention, for example, when viewed in section, has an upper surface and a lower surface, wherein one surface is planar and the other is inwardly curvilinear or bowed toward the planar surface, or alternatively, wherein both surfaces are inwardly curvilinear or concaved toward the other surface. Reference FIGS. 3 and 4.

The classifier wheel of the present invention can be satisfactorily operated at rotational velocities which are used in conventional classification separators, for example, from about 500 to about 25,000 revolutions per minute, with the result that the separation of fine from coarse particles is improved substantially over wheel geometries of the prior art.

Exemplary separations follow. Particles smaller than about 12 microns are separated from a population of particles ranging in size average diameters of from about 0.1 to about 1,000 microns, as practiced in, for example, a fluid bed grinder, where the larger particles are continuously ground until sufficiently small to be removed through the classifier wheel. Particles smaller than about 5 microns are separated from a population of particles ranging in size average diameter of from about 1 to about 12 microns, as practiced, for example, in a classifier, where under sized particles are removed.

In embodiments of the present invention, there are provided an apparatus and particle separation processes thereof with a sharpness index exceeding a value of about 0.7, for example, from about 0.7 to about 1.0.

The cut point of the apparatus and of a classification process corresponds to the nominal particle size at which two opposing and competing forces have substantially equal magnitudes. The magnitude of the two forces acting on an individual particle in a classifier, for example, air drag and centrifugal force, can be calculated using common fluid dynamics equations. These forces, and more importantly, their relative magnitudes, change with position within a classifier wheel. A plot of the cut point ($d_T$) versus radial position (R) can be drawn. Such a graphical analysis has been accomplished by R. Nied and Sickel and reported in an article "Modern Air Classifiers", in *Powder Handling and*

*Processing,* Vol. 4, No. 2, June 1992, the disclosure of which is incorporated herein in its entirety.

Figure 1A:
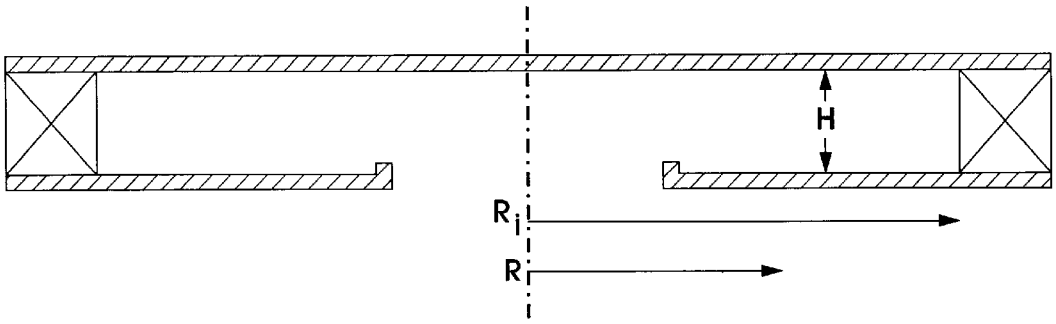
FIG. 1A PRIOR ART
FIG. 1*a* and 1*b*, respectively illustrate, a cross sectional profile of a classifier wheel and a classification profile of a prior art classifier wheel.
Figure 1B:
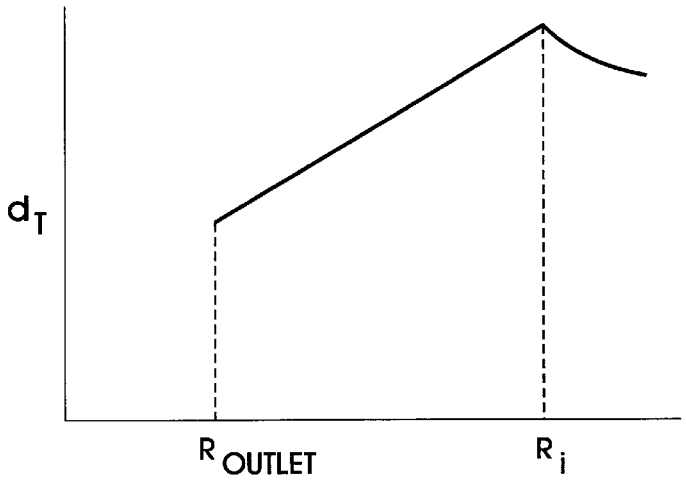
FIG. 1B PRIOR ART

Referring to the Figures, there is illustrated in FIG. 1*a* and 1*b*, respectively, a cross sectional profile of a classifier wheel and a classification profile of a prior art classifier wheel. The classifier geometry of FIG. 1*a* has a constant wheel height (H) which corresponds to a so called "decreasing" cut point profile which gives rise to a phenomena known as "trapping". This phenomenon is believed to be caused by the change in cut point as the material flows radially into the wheel interior. Particles, which are small enough to enter the outer region of the wheel, where the cut point is larger than the particles' nominal size, but are too large to pass through the inner region of the wheel, where the cut point is smaller than the particles' nominal size, may become trapped within the interior of the wheel. When particles of comparable size congregate in the critical separation region, transient congregation or aggregation of particles has the net effect that the aggregated or agglomerated particle, for separation considerations, behave and are processed as apparently larger particles. The result is that these transient aggregated or agglomerated particles are typically rejected from the separation process stream as "too large" or "oversize" particles, or may lead to fouling of the internal components of the classifier. In this situation, the rejection of apparent oversize particles impacts the efficiency of the separation process by, for example, lowering throughput, lowering yields, and necessitating more frequent equipment shut downs for maintenance.

The cut point profile shown in FIG. 1 b corresponds to the following equations:

$$d_T = \sqrt{18\eta \frac{V_r}{V_u^2} R \frac{1}{\rho}}$$

$$V_r = \frac{Q}{2\pi RH} \text{ and } V_u = \frac{V_{u,i} R_i}{R} = \frac{2\pi R_i^2 n}{R}$$

$$d_T = \sqrt{\frac{18\eta Q R^2}{8\rho\pi^3 R_i^4 n^2 H}}$$

wherein $d_T$ is the cut point, $\eta$ is the dynamic viscosity, $V_r$ is radial velocity, $V_u$ is tangential velocity, $\rho$ is the density of the particle material, Q is the volumetric airflow rate, n is the wheel speed in revolutions per unit time, H is the wheel height at a radius R, and the index i denotes the inner edge of the wheel vane. The constant height classifier geometry of FIG. 1 is widely used in industry and is characterized in that it allows for easy assembly in manufacture and the ability to attain increasingly lower cut points. However, there are shortcomings of this geometry, for example, since the cut point changes along the radial axis of the wheel, particles are rejected at different points along the path leading to the outlet. Large particles are rejected near the vane blades, while smaller particles may only be rejected near the outlet region. This is due to the change in particle size for which the outward centrifugal and inward aerodynamic drag forces are balanced. The outward centrifugal force experienced by a large particle near the vane blades is enough to overcome the inward drag force, causing such a particle to be expelled as soon as it enters the classifier wheel. For a small particle with little mass, the centrifugal force it experiences never becomes larger than the aerodynamic drag, and the particle is drawn through the entire classifier wheel and is able to exit the wheel through the central outlet. A medium sized particle is small enough to penetrate part of the way into the classifier wheel. At a certain position within the classifier wheel, the outward centrifugal force and the inward aerodynamic drag are balanced for this particle. The size of the particle corresponds to the cut point at that position within the classifier wheel. If the particle were to travel further into the wheel, the centrifugal force would overcome the aerodynamic force and the particle would be pushed outwards, while the reverse is true if the particle moved slightly outward. Consequently, a medium sized particle can theoretically become "trapped" in the interior of the classifier wheel. These particles become trapped in the wheel since they are too large to reach the outlet and too small to be rejected near the blades. Although not wanting to be limited by theory, it is believed that such a condition can be lead to spontaneous accumulation and expulsion of the trapped material in a complex, cyclical fashion. It is also reasonable to expect that this phenomenon is unlikely to be beneficial to sharp separation, since it leads to the rejection of agglomerated undersized material.

Figure 2A:
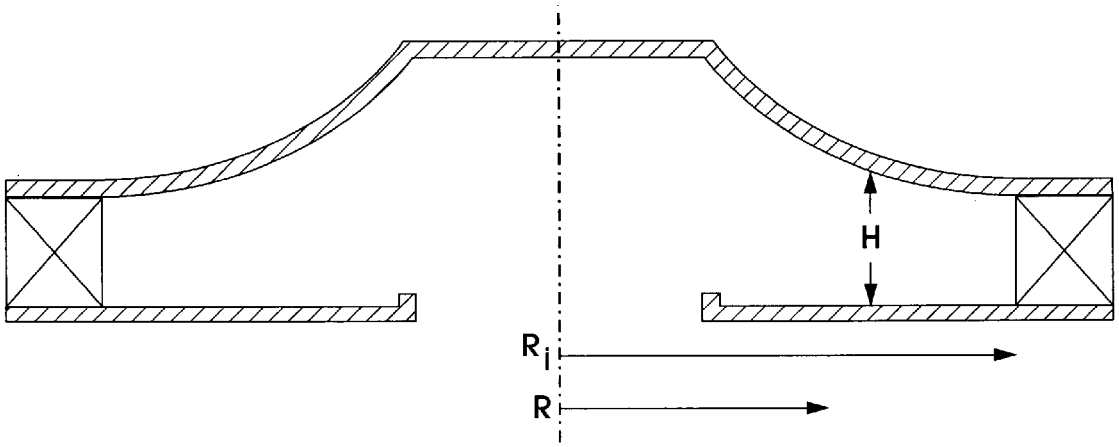
FIG. 2A PRIOR ART
FIG. 2*a* and 2*b*, respectively illustrate, a cross sectional profile of a classifier wheel and a cut point profile of a prior art classifier wheel.
Figure 2B:
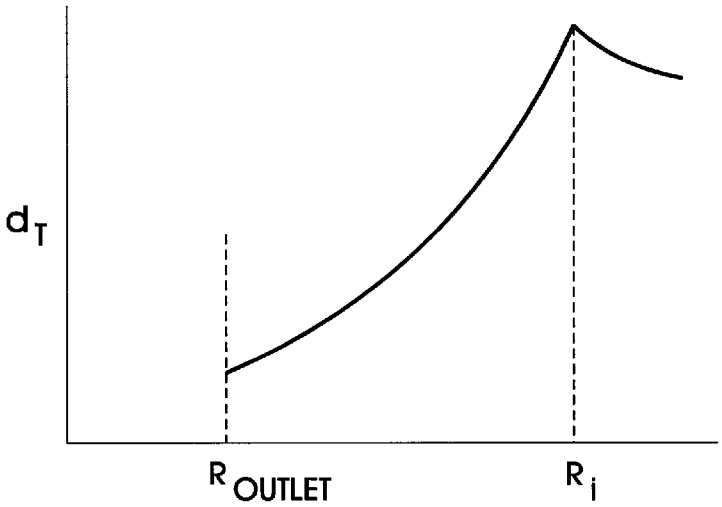
FIG. 2B PRIOR ART

With reference to FIG. 2*a* and 2*b*, there is illustrated a more recently commercially available wheel design available from Condux, GMBH, which uses a curved interior surface and a stepped outlet tube to reduce the influence of the aforementioned boundary layers. The wheel maintains a constant radial air velocity and has the cut point diagrammed in FIG. 2*b*. The geometry is able to achieve lower cut points than the constant height classifier represented in FIG. 1. However, the curved geometry of the constant radial velocity profile classifier wheel is believed to retain and substantially enhance the disadvantage of allowing particles to become "trapped" in the wheel. This geometry provides for easy manufacture and the ability to attain increasingly lower cut points by increasing the free vortex velocity in the wheel. The constant radial velocity wheel has a larger radius than a conventional wheel. Thus, the tangential velocity at the edge of the blades is larger, that is, tangential velocity is equal to the wheel radius times the wheel speed. The constant radial velocity wheel maintains the cross sectional area of the air flow constant with radius. In contrast, in a classifier wheel in accordance with the present invention, the free vortex velocity increases as the particles go into the wheel and encounter an ever-decreasing cross sectional area that the flow must go through.

Figure 3A:
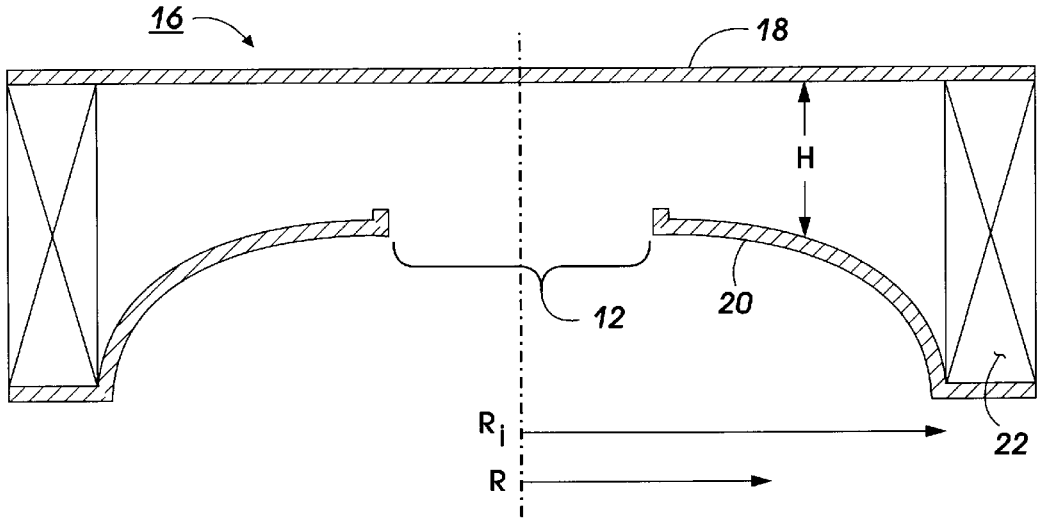
FIG. 3*a* and 3*b*, in embodiments of the present invention illustrate, respectively, a cross sectional profile of a classifier wheel, and a graphical representation of the corresponding cut point profile of a classifier wheel.
Figure 3B:
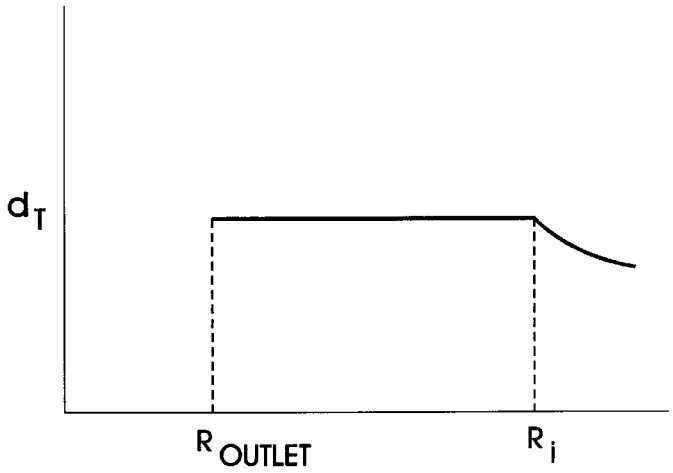

Referring to FIGS. 3*a* and 3*b*, there is illustrated, in embodiments of the present invention, a cross sectional profile of a classifier wheel, and a graphical representation of the corresponding classification profile of a classifier wheel, respectively. A constant cut point classifier in accordance with the present invention preferably has a wheel height (H), measured in for example, inches or centimeters, which is proportional to the square of the radial distance ($R^2$), measured in for example, inches or centimeters, that is, the ratio of $R^2/H$ is constant. Therefore, the height of the wheel is a function $R^2$, which results in wheel profile that corresponds to the relation $$d_T = \sqrt{\frac{18\eta Q R^2}{8\rho\pi^3 R_i^4 n^2 H}}$$

as defined previously. In the present invention, dr remains the same. To ensure that $d_T$ remains the same, H is systematically changed along the radius of the wheel. Therefore, the constant cut point wheel geometry of the present invention is curved, while the conventional wheel is planar or flat.

The constant cut point apparatus of the present invention has a wheel geometry which satisfies the relation $H = \text{constant} \times R^2$, where the constant can include or compensate for typical process variability of, for example, wheel airflow capacity, density of the gas and solid mixture, wheel speed range, and other mechanical or operational parameters that can alter the behavior of the classifier. Thus, in embodiments, slight variations in the constant are be expected without significantly affecting the cut point performance of the classifier wheel. A classifier wheel with this profile is expected to maintain a constant cut point from the inside edge of the vanes to the edge of the outlet. An advantage of a classifier wheel with a constant cut point geometry, as in the present invention, is that a particle entering the wheel is be less likely to be misclassified. Whereas in the prior art classifier geometry, for example, as in FIG. 1, a particle slightly larger than the cut point at $R_{outlet}$ would travel almost to the outlet region of the wheel before being rejected. The same particle entering a constant cut point classification wheel would be subjected to the same cut point throughout the wheel and would have a higher probability of rejection. Thus, the constant cut point geometry provides for a balance of separative forces at any point within the wheel geometry and therefore, no holdup is likely to occur and provides for greater operational efficiency. That is, the opportunity for misclassified particles is considerably lower than with the aforementioned prior art wheel geometries.

In another embodiment, reference respectively FIGS. 4*a* and 4*b*, of the present invention, there is illustrated an alternative wheel geometry which also satisfies the aforementioned criteria for a constant cut point wheel. The figure shown in 4*a* is an exemplary geometry wherein both the upper and lower wheel surfaces are inwardly curvilinear or concaved toward the other surface. However, in accordance with the above governing equations, the total curvature of the surfaces is constant so that, for example, the curvature of the lower surface in FIG. 3*a* is approximately twice the curvature of either the lower or upper surfaces in FIG. 4*a*. The upper and lower surfaces in a preferred embodiment are substantially symmetrical although a non symmetrical situation would also appear to be viable in view of the underlying principles described above.

Although not wanting to be limited by theory, it is believed that in either of the aforementioned and illustrated wheel geometries and equivalents thereof, the radius of the wheel is optionally larger than the prior art wheel size so as to attain a sufficiently low cut point on the inside edge of the classifier blade. Another alternative would be to decrease the amount of air flowing through the wheel.

Toner compositions can be prepared by a number of known methods, such as admixing and heating resin particles obtained with the processes of the present invention such as water soluble styrene butadiene copolymer derivatives, pigment particles such as magnetite, carbon black, or mixtures thereof, and cyan, yellow, magenta, green, brown, red, or mixtures thereof, and preferably from about 0.5 percent to about 5 percent of charge enhancing additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 6 to about 12 microns, which diameters are determined by a Coulter Counter. Subsequently, the toner compositions can be classified utilizing, for example, a Donaldson Model B classifier for the purpose of removing toner fines, that is toner particles less than about 4 microns volume median diameter. Alternatively, the toner compositions are ground with a fluid bed grinder equipped with a classifier wheel constructed in accordance with the present invention, and then classified using a classifier equipped with a classifier wheel constructed in accordance with the present invention.

Illustrative examples of resins suitable for toner and developer compositions of the present invention include branched styrene acrylates, styrene methacrylates, styrene butadienes, vinyl resins, including branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include styrene butadiene copolymers, mixtures thereof, and the like. Other preferred toner resins include styrene/n-butyl acrylate copolymers, PLIOLITES®; suspension polymerized styrene butadienes, reference U.S. Pat. No. 4,558,108, the disclosure of which is totally incorporated herein by reference.

In toner compositions, the resin particles are present in a sufficient but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black like REGAL 330®, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected.

When the pigment particles are comprised of magnetites, thereby enabling single component toners in some instances, which magnetites are a mixture of iron oxides ($FeO \cdot Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are optionally present in the toner composition or the polymer resin beads of the present invention in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents.

Encompassed within the scope of the present invention are colored toner and developer compositions comprised of toner resin particles, carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with charge enhancing additives, illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. No. 3,526,533, U.S. Pat. No. 4,937,166, and U.S. Pat. No. 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns, and in embodiments about 175 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition of the present invention can be prepared by a number of known methods as indicated herein including extrusion melt blending the toner resin particles, pigment particles or colorants, and a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The toner and developer compositions may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The toner compositions are usually jetted and classified subsequent to preparation to enable toner particles with a preferred average diameter of from about 5 to about 25 microns, more preferably from about 8 to about 12 microns, and most preferably from about 5 to about 8 microns. Also, the toner compositions preferably possess a triboelectric charge of from about 0.1 to about 2 femtocoulombs per micron as determined by the known charge spectrograph. Admix time for toners are preferably from about 5 seconds to 1 minute, and more specifically from about 5 to about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Also, the toner compositions prepared, in embodiments, of the present invention possess desirable narrow charge distributions, optimal charging triboelectric values, preferably of from 10 to about 40, and more preferably from about 10 to about 35 microcoulombs per gram as determined by the known Faraday Cage methods with from about 0.1 to about 5 weight percent in one embodiment of the charge enhancing additive; and rapid admix charging times as determined in the charge spectrograph of less than 15 seconds, and more preferably in some embodiments from about 1 to about 14 seconds.

The classifying apparatus of the present invention, in embodiments, can be constructed using known materials and fabrication techniques and as illustrated herein. In embodiments, a conventional classifier or fluid bed grinder may be readily adapted or retrofitted with constant cut point classifier wheel geometries of the present invention to achieve the aforementioned benefits and advantages, and as illustrated herein. In embodiments, the classifier wheels of the present invention can be constructed or coated with wear resistant material, for example, ceramic, ceramer, composite, and the like, abrasion resistant surface coatings.

The invention will further be illustrated in the following non limiting Example, it being understood that this Example is intended to be illustrative only and that the invention is not intended to be limited to the materials, conditions, process parameters, and the like, recited herein. Parts and percentages are by weight unless otherwise indicated.

EXAMPLE

Magnetic Toner Preparation and Evaluation

A polymer resin (74 weight percent of the total mixture) obtained by free radical polymerization of mixtures of styrene and butadiene may be melt extruded with 10 weight percent of REGAL 330® carbon black and 16 weight percent of MAPICO BLACK® magnetite at 120° C., and the extrudate pulverized in a Waring blender and jetted and classified to 8 micron number average sized particles as measured by a Coulter counter with a classifier equipped with a classifier wheel as illustrated herein, reference for example, FIG. 4*a*. A positively charging magnetic toner may be prepared by surface treating the jetted toner (2 grams) with 0.12 gram of a 1:1 weight ratio of AEROSIL R972® (Degussa) and TP-302 a naphthalene sulfonate and quaternary ammonium salt (Nachem/Hodogaya SI) charge control agent.

Developer compositions may then be prepared by admixing 3.34 parts by weight of the aforementioned toner composition with 96.66 parts by weight of a carrier comprised of a steel core with a polymer mixture thereover containing 70 percent by weight of KYNAR®, a polyvinylidene fluoride, and 30 percent by weight of polymethyl methacrylate; the coating weight being about 0.9 percent. Cascade development may be used to develop a Xerox Model D photoreceptor using a "negative" target. The light exposure may be set between 5 and 10 seconds and a negative bias used to dark transfer the positive toned images from the photoreceptor to paper.

Fusing evaluations may be carried out with a Xerox Corporation 5028® soft silicone roll fuser, operated at 7.62 cm (3 inches) per second.

The actual fuser roll temperatures may be determined using an Omega pyrometer and was checked with wax paper indicators. The degree to which a developed toner image adhered to paper after fusing is evaluated using a Scotch® tape test. The fix level is expected to be excellent and comparable to that fix obtained with toner compositions prepared from other methods for preparing toners. Typically greater than 95 percent of the toner image remains fixed to the copy sheet after removing a tape strip as determined by a densitometer. Alternatively, the fixed level may be quantitated using the known crease test, reference the aforementioned U.S. Pat. No. 5,312,704.

Images may be developed in a xerographic imaging test fixture with a negatively charged layered imaging member comprised of a supporting substrate of aluminum, a photogenerating layer of trigonal selenium, and a charge transport layer of the aryl amine N,N'-diphenyl-N,N'-bis(3-methylphenyl)1,1'-biphenyl-4,4'-diamine, 45 weight percent, dispersed in 55 weight percent of the polycarbonate MAKROLON®, reference U.S. Pat. No. 4,265,990, the disclosure of which is totally incorporated herein by reference; images for toner compositions prepared from the copolymers derived from for example, Example XI are expected to be of excellent quality with no background deposits and of high resolution over an extended number of imaging cycles exceeding, it is believed, about 75,000 imaging cycles.

Other toner compositions may be readily prepared by conventional means from the pigmented thermoplastic resins particles and the improved classification apparatus and processes thereof of the present invention, including colored toners, single component toners, multi-component toners, toners containing special performance additives, and the like.

In embodiments, the apparatus and processes of the present invention can be selected for and employed in the separation classification of friable and non-friable particulate materials including, but not limited to, crystalline, semicrystalline, and amorphous materials, for example, organics and inorganics, composites thereof, and mixtures thereof. Organics include, for example, resins, polymers, elastomers, dyes, pigments, pharmaceuticals, latex particles, and the like. Inorganics include, for example, metals, metal oxides, minerals, and the like, and mixtures thereof, such magnetites and silicas. Composites include, for example, compounded or physical mixtures of organic compounds and inorganic compounds.

Other modifications of the present invention may occur to one of ordinary skill in the art based upon a review of the present application and these modifications, including equivalents thereof, are intended to be included within the scope of the present invention.

What is claimed is:

1. An apparatus for solid particulate classification, comprising:

a housing provided with a feed inlet, a fine fraction outlet, and a coarse fraction outlet; and a classifier wheel having an upper and lower surface, and a plurality of blade vanes connecting the upper surface to the lower surface at the peripheral edges of the upper and lower surfaces, wherein the wheel has a constant cut point geometry, and wherein the solid particulates are entrained in a fluid.

2. An apparatus in accordance with claim 1, wherein the constant cut point geometry is determined by $$d_T = \sqrt{\frac{18\eta Q R^2}{8\rho\pi^3 R_i^4 n^2 H}}$$

wherein $d_T$ is the cut point, η is the dynamic viscosity, Q is the volumetric air flow rate, ρ is the density of particle material, n is the wheel speed in revolutions per unit time, H is the wheel height at a radial distance R, and the index i denotes the inner edge of the wheel vane.

3. An apparatus in accordance with claim 1, wherein the constant cut point geometry is determined by the relation, $H=\text{constant}\times R^2$ where H is the wheel height at a radial distance R.

4. An apparatus in accordance with claim 1, wherein the upper surface resides in a horizontal plane, and the lower surface is inwardly curvilinear in the direction of the plane from about the peripheral lower edge of the wheel to about the center lower edge of the wheel.

5. An apparatus in accordance with claim 1, wherein the lower surface resides in a horizontal plane, and the upper surface is inwardly curvilinear in the direction of the plane from about the peripheral upper edge of the wheel to about the center of the wheel.

6. An apparatus in accordance with claim 1, wherein the upper surface and the lower surface are inwardly curvilinear from about the peripheral edges of the wheel to about the center edges of the wheel.

7. An apparatus in accordance with claim 1, wherein the fluid is a gas.

8. An apparatus in accordance with claim 1, wherein the fluid is air.

9. An apparatus in accordance with claim 1, wherein the solid particulates are a toner formulation comprising a pigment and a resin.

10. An apparatus in accordance with claim 1, wherein the solid particulates are selected from the group consisting of organics, inorganics, composites thereof, and mixtures thereof.

11. An apparatus in accordance with claim 1, wherein the particle size of the constant cut point is from about 1 to about 1,000 microns.

12. An apparatus in accordance with claim 1, wherein the classifier wheel has a sharpness index value of from about 0.7 to about 1.0.

13. A process for separating and classifying particulates comprising:

providing an apparatus for the radial flow classification of solid particulate materials entrained in a fluid, comprising a housing provided with a feed inlet, a fine fraction outlet, and a coarse fraction outlet; and a classifier wheel having an upper surface, a lower surface, and a plurality of blade vanes connecting the upper surface to the lower surface at the peripheral edges, and wherein the wheel has a constant cut point geometry;

rotating the wheel at high speed of from about 500 to about 25,000 revolutions per minute; and providing a solid particle feed comprising a fluid stream containing particulates of from about 0.1 to about 1,000 microns in diameter to the apparatus, wherein the particulates in the fluid stream are classified according to a constant cut point within the apparatus to permit fine particles move to the center of the wheel and thereafter exit the housing via the fine fraction outlet, and the coarse particles move to the periphery of the wheel and exit the wheel via the coarse fraction outlet.

14. A process in accordance with claim 13, wherein the classifier wheel has a constant cut point geometry determined by $$d_T = \sqrt{\frac{18\eta Q R^2}{8\rho\pi^3 R_i^4 n^2 H}}$$

wherein $d_T$ is the cut point, η is the dynamic viscosity, Q is the volumetric air flow rate, ρ is the density of particle material, n is the wheel speed in revolutions per unit time, H is the wheel height at a radial distance R, and the index i denotes the inner edge of the wheel vane.

15. A process in accordance with claim 13, wherein the classifier wheel has an upper surface and a lower surface, wherein the upper surface and lower surface geometry is selected from the group consisting of a) one surface is substantially planar and the other is inwardly curvilinear or concaved, and b) wherein both surfaces are inwardly curvilinear or concaved.

16. A process in accordance with claim 13, wherein the revolutions per minute is from about 500 to about 25,000.

17. A process in accordance with claim 13, wherein the constant cut point is from about 0.1 to about 1,000 microns.

18. A process in accordance with claim 13, wherein constant cut point is from about 1 to about 10 microns.

19. A process in accordance with claim 13, wherein the solid particulate is a selected from the group consisting of organics, inorganics, composites thereof, and mixtures thereof.

20. A process in accordance with claim 13, wherein the solid particulate is a toner composition comprised of a mixture of resin and pigment particles.

* * * * *